US006661350B1

(12) United States Patent
Rohrberg et al.

(10) Patent No.: US 6,661,350 B1
(45) Date of Patent: Dec. 9, 2003

(54) MINIATURE REMOTE CONTROL SYSTEM

(75) Inventors: Roderick G. Rohrberg, Torrance, CA (US); Timothy K. Rohrberg, Torrance, CA (US); Charles E. Nourrcier, Lakewood, CA (US)

(73) Assignee: Creative Commands Corporation, Torrance, CA (US)

( * ) Notice: Subject to any disclaimer, the term of this patent is extended or adjusted under 35 U.S.C. 154(b) by 0 days.

(21) Appl. No.: 09/419,058

(22) Filed: Sep. 24, 1999

(51) Int. Cl.[7] ..... G08C 19/00

(52) U.S. Cl. ..... 340/825.69; 340/825.72; 340/539.1

(58) Field of Search ..... 340/825.69, 825.72, 340/539, 539.1

(56) References Cited

U.S. PATENT DOCUMENTS

| | | | | |
|---|---|---|---|---|
| 3,906,348 A | | 9/1975 | Wilmott | 340/825.63 |
| 3,967,133 A | | 6/1976 | Bokern | 307/10.1 |
| 4,241,870 A | | 12/1980 | Marcus | 296/37.8 |
| 4,286,262 A | * | 8/1981 | Wahl | 340/539 |
| 4,409,592 A | | 10/1983 | Hunt | 340/825.5 |
| 4,529,980 A | | 7/1985 | Liotine | 340/696 |
| 4,665,395 A | | 5/1987 | Van Ness | 340/5.25 |
| 4,771,399 A | | 9/1988 | Snowden | 365/226 |
| 4,827,520 A | | 5/1989 | Zeinstra | 381/41 |
| 4,912,463 A | | 3/1990 | Li | 340/825.69 |
| 4,988,992 A | | 1/1991 | Heitschel | 340/825.69 |
| 5,007,863 A | | 4/1991 | Xuan | 439/639 |
| 5,073,721 A | | 12/1991 | Terrill | 307/10.7 |
| 5,148,159 A | | 9/1992 | Clark | 340/725.69 |
| 6,154,544 A | * | 11/2000 | Farris et al. | 340/825.72 |

* cited by examiner

*Primary Examiner*—Donnie L. Crosland
(74) *Attorney, Agent, or Firm*—Thomas N. Giaccherini

(57) ABSTRACT

A Miniature Remote Control System (10) that overcomes the problems encountered by previous remote control devices is disclosed. The present invention uses a remote emitter (12) which integrates a radio transmitter circuit (60) in a small housing (34) that plugs into an existing lighter receptacle (28) in a vehicle (V). When pushed down, the remote emitter (12) transmits a coded serial pulse train (16) to a remote receiver (14) up to 200 feet away. The pulse train (16) has a unique code (20) (one of 19,683) on a 380 MHz carrier frequency. The remote receiver (14) processes the pulse train (16), and extracts the serial transmitter code (20). The transmitter code (20) is then compared to the preset receiver code (22), and, if a match is found, a relay (104) is triggered. When activated, the relay (104) can be used to operate external devices (ED), including garage doors (GD), security gates (SG), burglar alarms (SA), exterior lights (EL) or interior lights (IL).

14 Claims, 14 Drawing Sheets

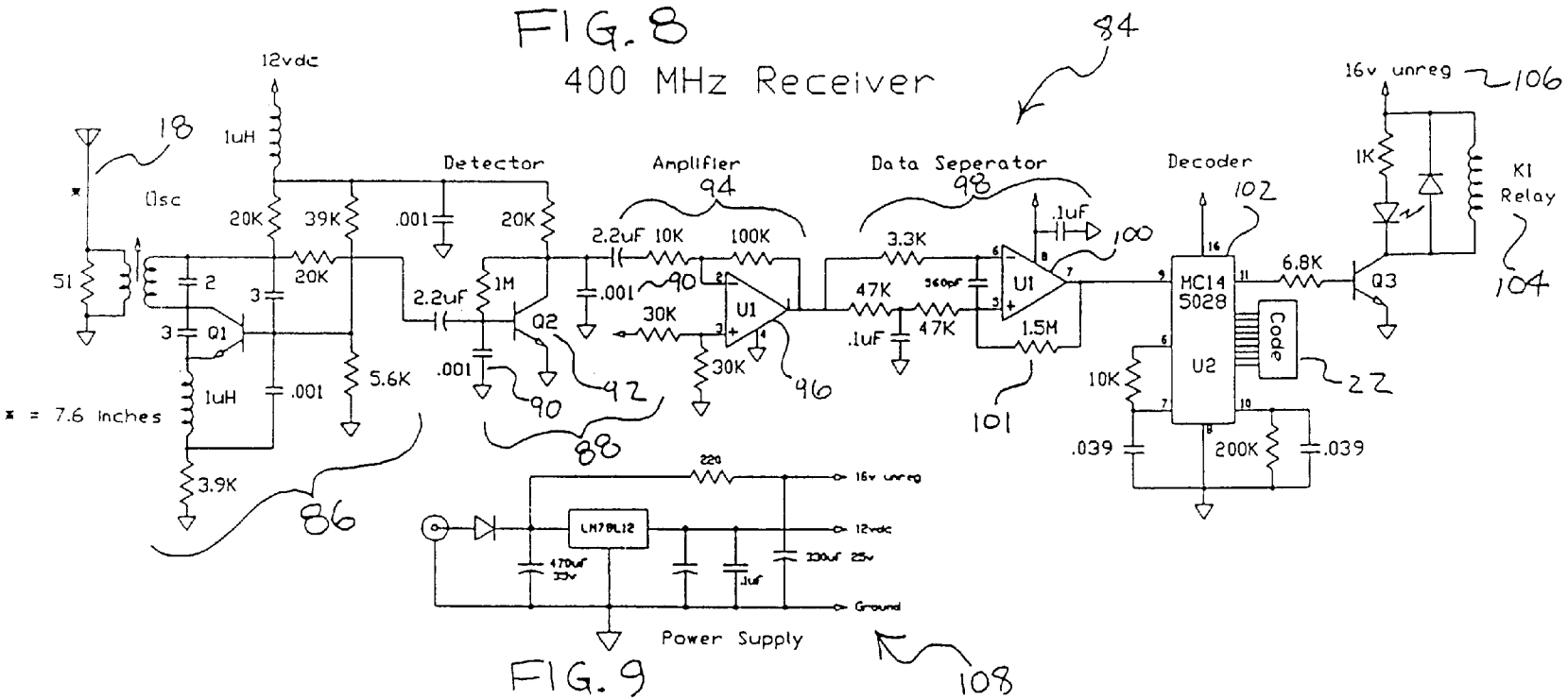
FIG. 8
400 MHz Receiver
FIG. 9
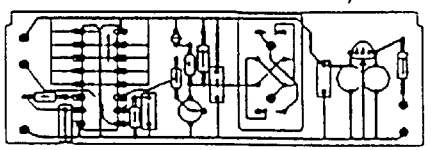
FIG. 11
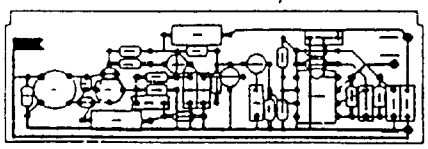
FIG. 10

Fig. 27
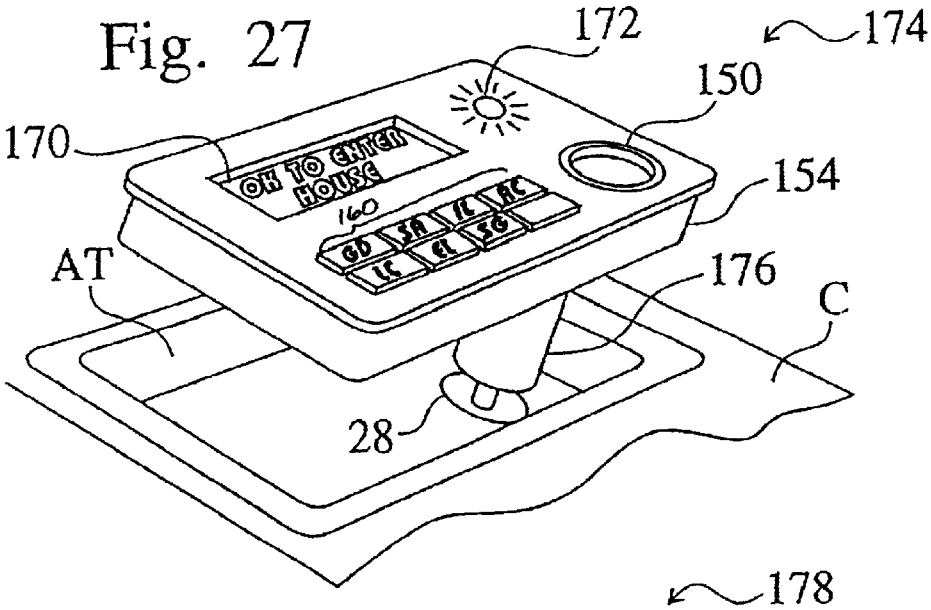
Fig. 28
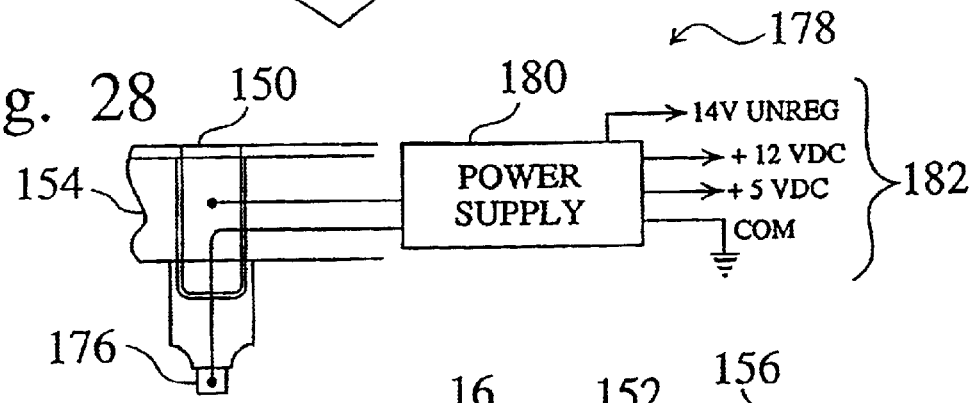
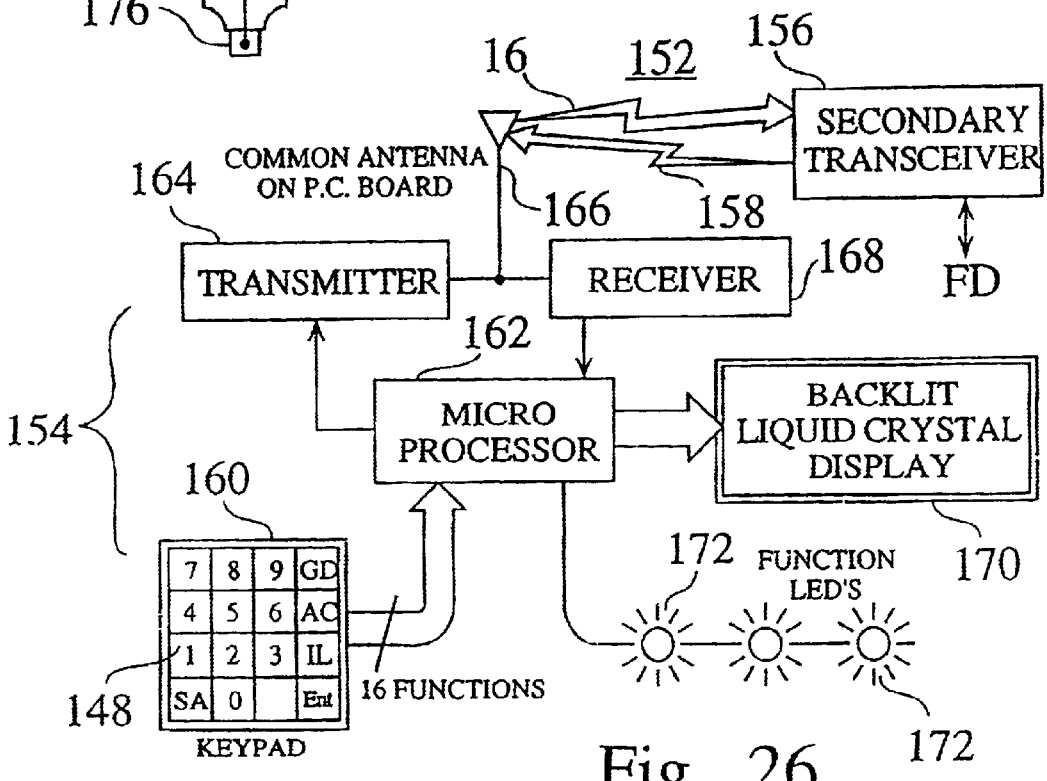
Fig. 26

MINIATURE REMOTE CONTROL SYSTEM

CROSS-REFERENCE TO RELATED PATENT APPLICATIONS & CLAIMS FOR PRIORITY

The Applicants hereby claim the benefit of priority for any and all subject matter disclosed in pending U.S. patent application Ser. No. 08/796,853, filed on Feb. 6, 1997 now abandoned, in pending U.S. patent application Ser. No. 08/459,688, filed on Jun. 2, 1995, which is now abandoned; and in U.S. patent application Ser. No. 08/060,455, filed on May 10, 1993, which is now abandoned.

FEDERALLY SPONSORED RESEARCH OR DEVELOPMENT

Not Applicable.

FIELD OF THE INVENTION

The present invention relates to radio frequency transmitters. More particularly, this invention provides a miniature transmitter that is small enough to fit within a cigarette lighter socket in an auto dashboard. This invention also provides a receiver which, when activated by the transmitter, is able to operate electrical appliances that are connected to the receiver.

BACKGROUND OF THE INVENTION

Remotely operated garage door openers are a widely used consumer accessory, and are commonly located and activated from a user's vehicle. These devices provide convenience, security and accessibility for many people who desire or require such a system. Remote operation of garage doors, security gates, lighting and alarms has become a necessity for many people.

Existing remote controllers for use in vehicles have had numerous problems associated with their functionality, reliability, security and their location within the vehicle. Common hand-held remote controllers are often bulky and difficult to use. Hand-held units are usually battery operated and commonly malfunction when the stored battery charge is low. Since vehicles are operated in many weather conditions, the available power from battery operated controllers is diminished in cold temperatures.

Hand-held units are also easily misplaced, either within the vehicle or by inadvertent removal from the vehicle. Looking for a misplaced remote controller can pose a safety problem in a moving vehicle. Hand-held remote controllers are also prone to damage, as they are commonly used at the same time the user is busy operating a motor vehicle. Previous attempts to provide a convenient means for control of remote systems from the auto dashboard have met with limited results.

In U.S. Pat. No. 4,286,262, Wahl discloses a system for opening garage doors in which a radio receiver in the garage, upon receipt of a signal, operates to open the garage door and in which a casing containing a radio transmitter is adapted for insertion into the socket of a cigarette lighter in the driver's compartment of a motor car. Wahl also discloses a radio transmitting device in which a casing containing a radio transmitter is insertable into a socket of any type at any location together with means for energizing the transmitter to emit a signal when the casing has been inserted in the socket, for whatever purpose the signal may be utilized.

In U.S. Pat. No. 3,967,133, Bokern teaches the construction and use of a relatively simple compact and portable device which makes power available at different desired voltages even at remote locations. Bokern also states that his device may include means which obviate the possibility of a polarity reversal or misconnection.

In U.S. Pat. No. 5,007,863, Xuan discloses a module-type multi-function power outlet adapter for use of add-on electrical accessories in an automotive vehicle having a cigarette lighter socket. This device embodies a plurality of separate detachable modules which may be attached to a basic module insertable into the lighter socket and constructed to receive the additional modules, so to provide multiple electrical outputs. A simple positioning pin structure ensures correct power leads connection and secures the combination between modules. The resulting solid structure allows easy reception for plug-in accessory equipment.

In U.S. Pat. No. 5,073,721, Terrill et al. disclose a noise immune electronic switch which is connectible between a cigarette lighter socket of a vehicle and a plug-in accessory device.

In U.S. Pat. No. 4,529,980, Liotine et al. Transmitter and receivers for controlling remote elements which use a synchronous serial transmission format and which allows changes in coding to be automatically made between the receiver and transmitter and wherein the code is stored in memories of the transmitter and receiver and wherein the receiver can generate and transmit a new code with a light emitting diode so as to change the code in the transmitter. The transmitter and the receiver use micro-computers which are suitably programmed and include non-volatile memories.

In U.S. Pat. No. 4,409,592, Hunt discloses a packet communication system employing a carrier sense multiple access protocol with detection, with an improved means of collision detection and with an improved means for managing access to a communication medium or channel.

In U.S. Pat. No. 4,988,992, Heitschel et al. disclose a system for establishing a code and controlling operation of equipment. The system includes a transceiver including a receiver for the signal generated by the first transmitter and memory for storing the code carried by that signal. The transceiver includes a second transmitter for transmitting a radio frequency signal carrying the code.

In U.S. Pat. No. 5,148,159, Clark et al. disclose a remote control system including one or more portable units and base unit which employs identification codes for security.

In U.S. Pat. No. 4,665,395, Van Ness discloses an automatic vehicular access control system for use by various government, business and private operations having a need to control the entrance of vehicles to their grounds or facilities.

In U.S. Pat. No. 4,912,463, Li discloses a remote control apparatus which has a transmitter which is capable of being switched between a normal position and a changing position, and a receiver which is capable of being switched between a normal mode and a changing mode.

In U.S. Pat. No. 4,827,520, Zeinstra discloses a voice actuated control system for controlling vehicle accessories.

In U.S. Pat. No. 4,771,399, Snowden et al. disclose a memory programming system which provides a method and apparatus for programming and reading an electronic device memory through its power source connections.

In U.S. Pat. No. 3,906,348, Wilmott discloses a serially transmitted code which can be detected by a receiver.

In U.S. Pat. No. 4,241,870, Marcus discloses a housing mounted between the visors in the headliner of a vehicle for receiving and supplying operating power to a remote transmitter used for opening garage doors.

Previous inventions, such as the device described in U.S. Pat. No. 4,241,870 by Marcus, have located the portable transmitter unit in a overhead location within the motor vehicle, picking up electrical power through a socket located in an overhead console. These units rely on carrier signal technologies, and require line-of-sight operation through the vehicle windshield. Marcus claims that by mounting the transmitter high in a console, the radio waves will exit through the windshield, thus providing the required line of sight operation. Marcus located the controller overhead, in the visor area of an automobile, which has met with minimal acceptance by both automobile manufacturers and consumers. These controller modules are unique to different vehicle models. They impair vision out the front of the vehicle, and cannot be applied to many models, such as convertibles. Special wiring extensions to supply power to these overhead consoles are also required, adding to the manufacturing cost of vehicles supplied with such systems.

Hand-held transmitter systems that require a specialized storage area within a vehicle tend to be inappropriate for the interior designs of most vehicle manufacturers. Most hand-held transmitters use carrier signals that require "line of site" operation through the vehicle windshield area. These transmitters use carrier signals with a small number of unique codes. This can pose a security risk when security gates and garage doors are opened inadvertently or deliberately by other transmitters that use the same carrier signal code.

U.S. Pat. No. 3,906,348, by Wilmott, provided further encoding and decoding for transmitter and receivers for digital radio control, but the hardware design is inappropriately expensive for integration into a consumer product.

Previous remote controllers have been used in motor vehicles to operate garage doors and similar devices. These existing remote controllers are typically large, awkward, and have proven to be difficult to integrate with modern automobile design. While large automobiles, such as Cadillacs™ and Lincolns™, may have enough room over the rear-view mirror, most cars do not have enough space for such large devices. Since most controller designs require line of sight operation, they are susceptible to interference. A significant number of existing remote controller designs fail to offer reasonable security for the user, due to a large number of users and a small number of unique codes. The development of a miniaturized, inexpensive remote controller that can be installed directly in an existing cigarette lighter enclosure, that can provide interference-free operation from a reasonable distance, while providing a large number of unique codes, would constitute a major technological advance. The enhanced performance that could be achieved using such an innovative device would constitute a major technical advance and satisfy a long felt need within the consumer marketplace.

SUMMARY OF THE INVENTION

The Miniature Remote Control System disclosed and claimed below overcomes the problems encountered by previous mobile remote control systems. The Miniature Remote Control System integrates a radio circuit in a small device that can fit inside a cigarette lighter enclosure in an automobile, truck, van, forklift or other vehicle. When activated, it can be used to open garage doors and security gates, activate or deactivate burglar alarms, turn on lights inside or outside the home, or activate other devices from a remote location.

The remote control transmits a coded serial pulse train to a receiver up to 200 feet away. The transmitter board fits inside a cigarette lighter housing and simply plugs into the existing lighter receptacle in a car. A miniature switch located on top of this housing is manually activated to transmit a unique code (one of 19,683) on a 380 MHz carrier frequency. The receiver processes the carrier signal, and extracts the serial code. The code is then compared to the preset code, and, if a match is found, a relay is triggered.

The innovative Miniature Remote Control System incorporates the latest remote control technology in a package that is small, safe, reliable, cost-effective, and appropriate for wide acceptance throughout the automotive industry. Installation of the present invention simply entails replacing a standard cigarette lighter with the a remote emitter, which is designed to fit within and operate from a standard lighter receptacle, which is supplied and conveniently located within all modern vehicles. The majority of people who drive vehicles do not smoke, allowing wide market acceptance of the use of the remote emitter located within the standard lighter receptacle. This invention will become the standard-bearer for remote control technology and constitutes a major step forward in the field of automotive accessory design.

An appreciation of other aims and objectives of the present invention and a more complete and comprehensive understanding of this invention may be achieved by studying the following description of a preferred embodiment and by referring to the accompanying drawings.

A BRIEF DESCRIPTION OF THE DRAWINGS

Figure 4:
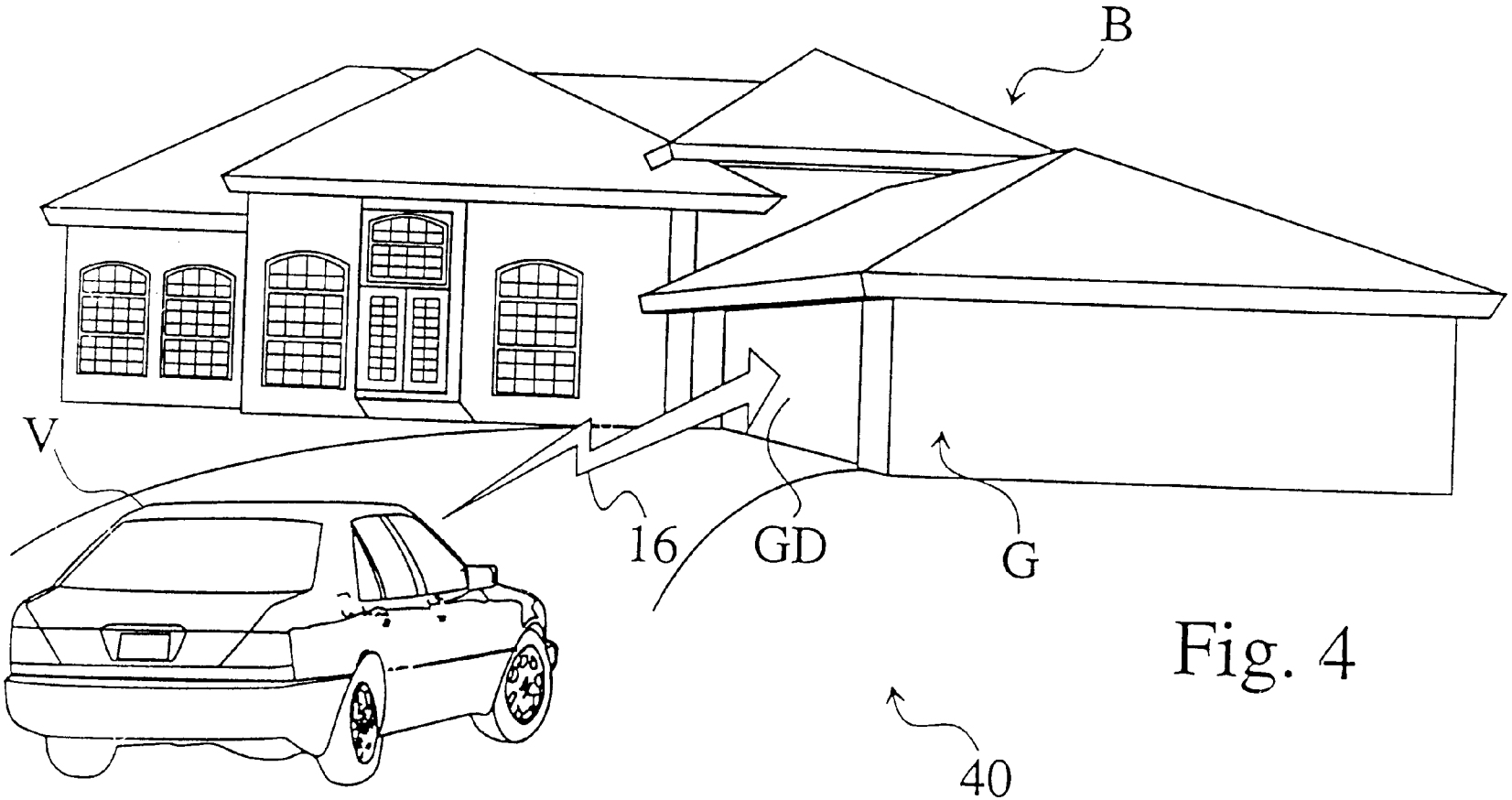

FIG. 4 offers a detailed view of a carrier signal being emitted from a vehicle equipped with the remote emitter, as the vehicle approaches the location of the remote receiver.

Figure 5:
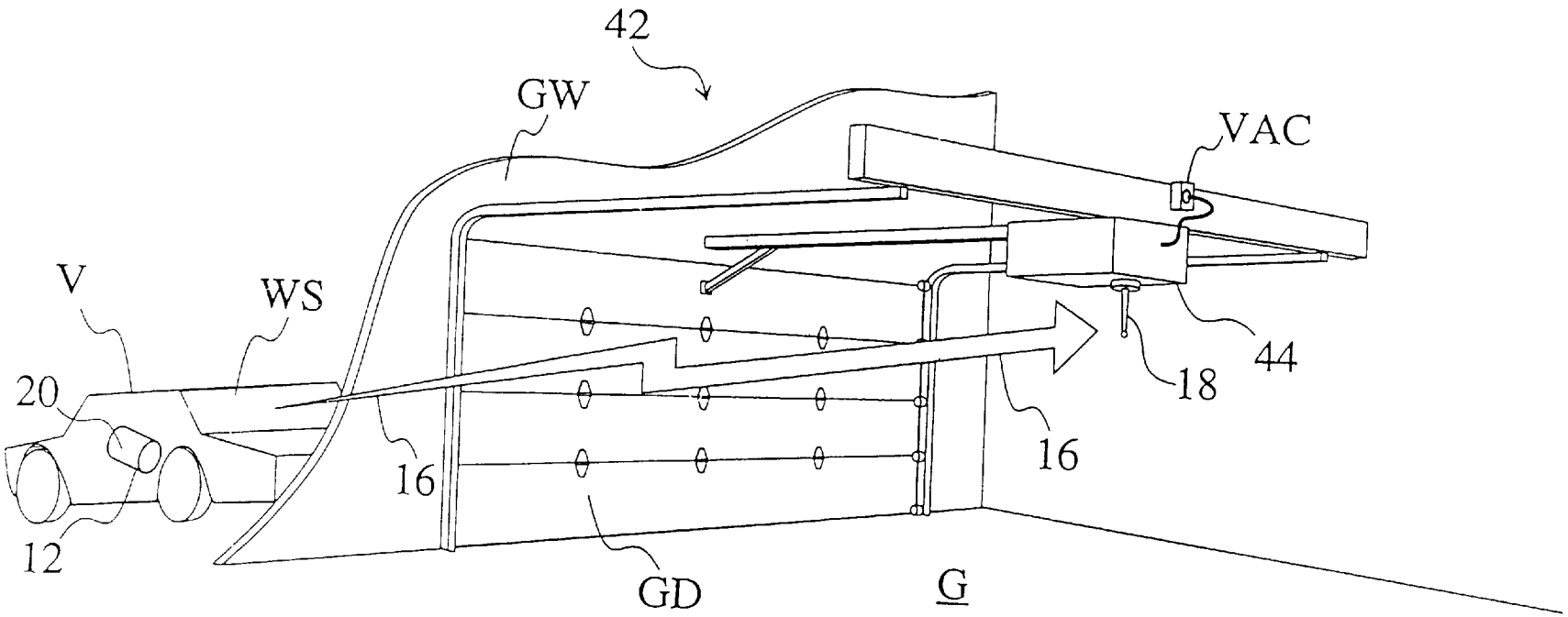

FIG. 5 is an alternative embodiment of the present invention, in which the remote receiver is an integral component of a garage door opener.

Figure 6:
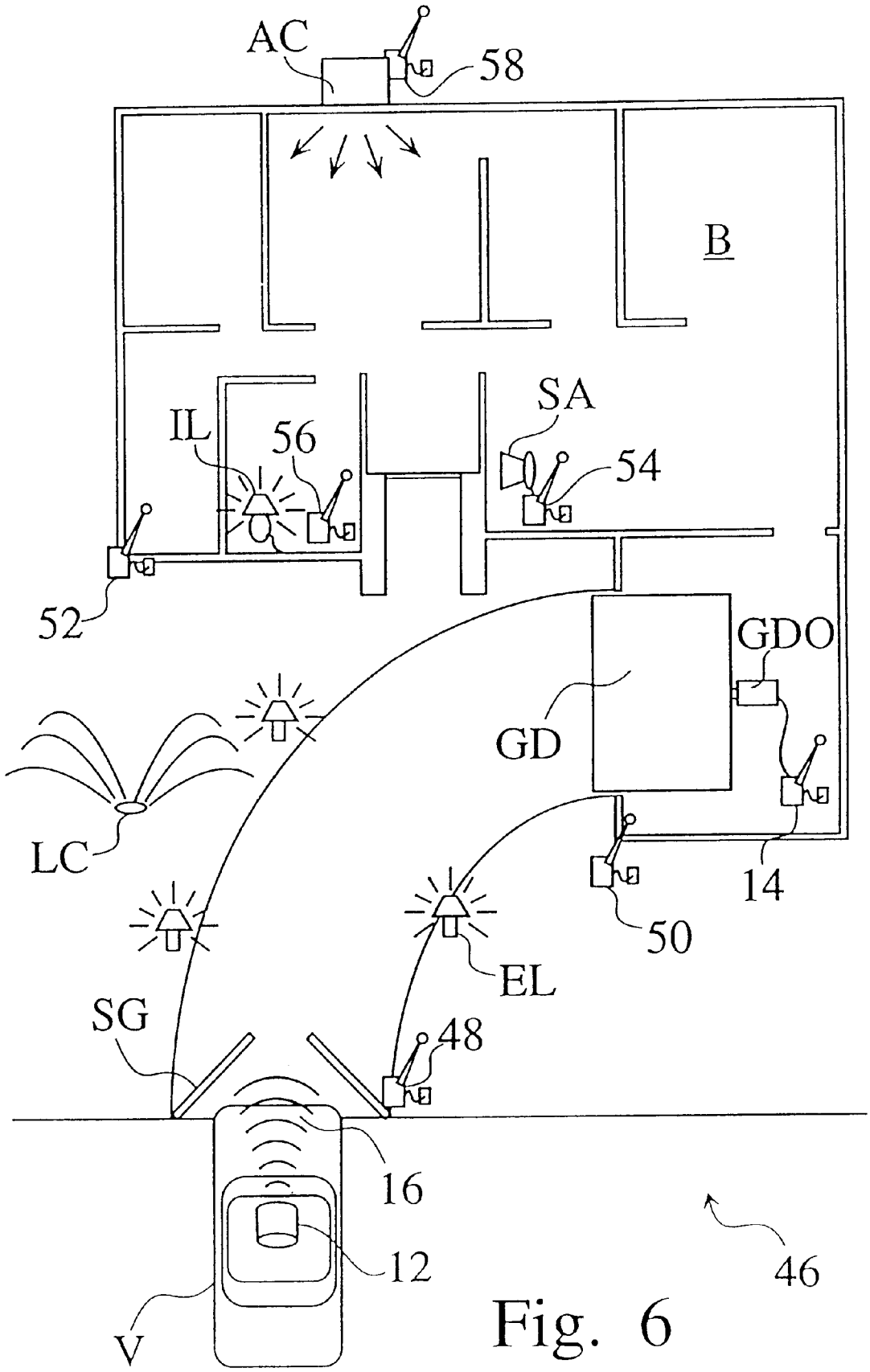

FIG. 6 is a plan view that illustrates some of the remote control applications for which the Miniature Remote Control System can be used.

Figure 7:
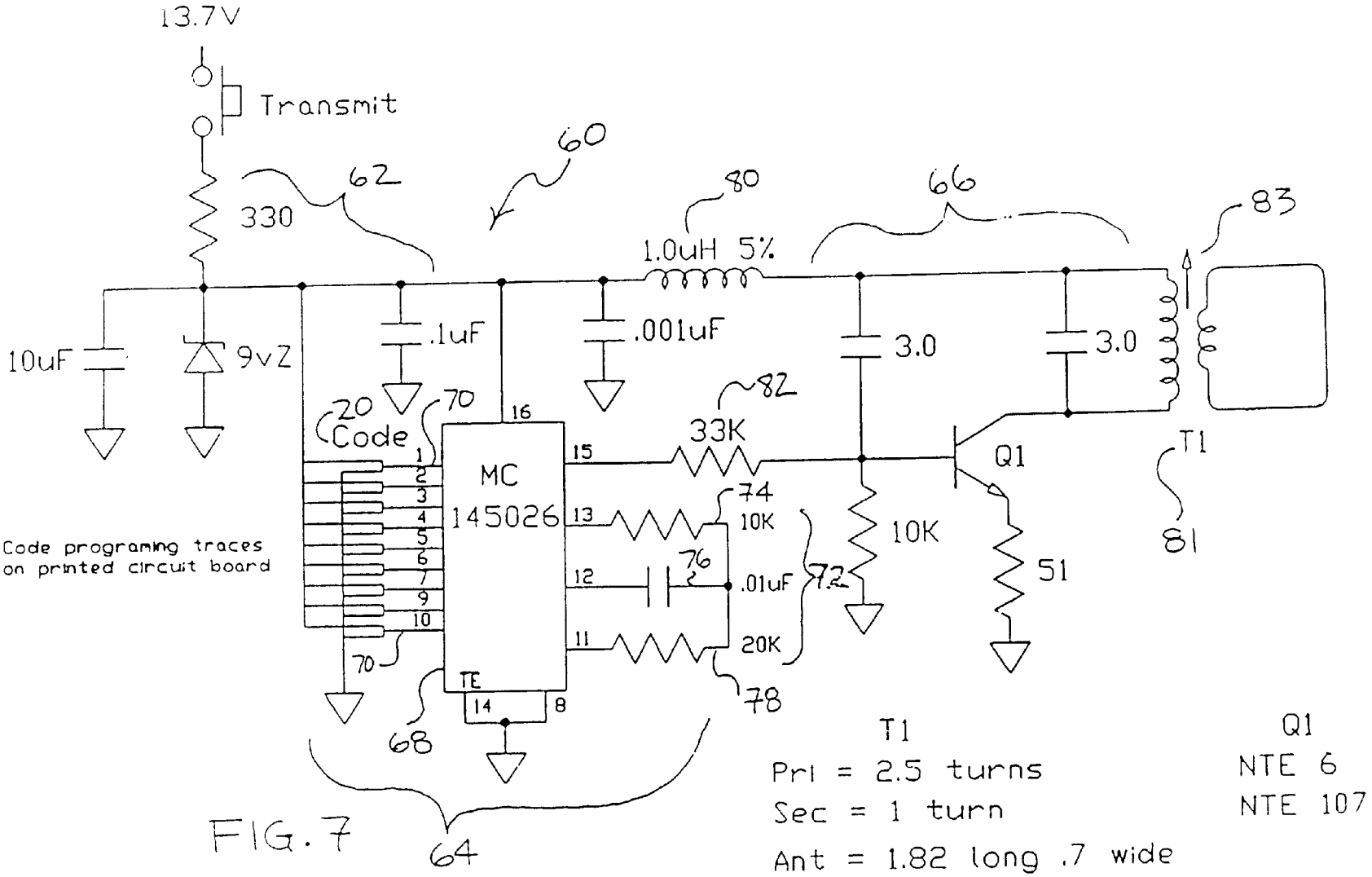

FIG. 7 is a schematic of the remote emitter.

FIG. 8 is a schematic diagram of the remote receiver.

FIG. 9 is a schematic of the receiver power supply.

FIG. 10 is a depiction of the receiver board layout for the present invention.

FIG. 11 shows an embodiment of the second receiver board layout.

Figures 12, 13, 14, 15, 16:
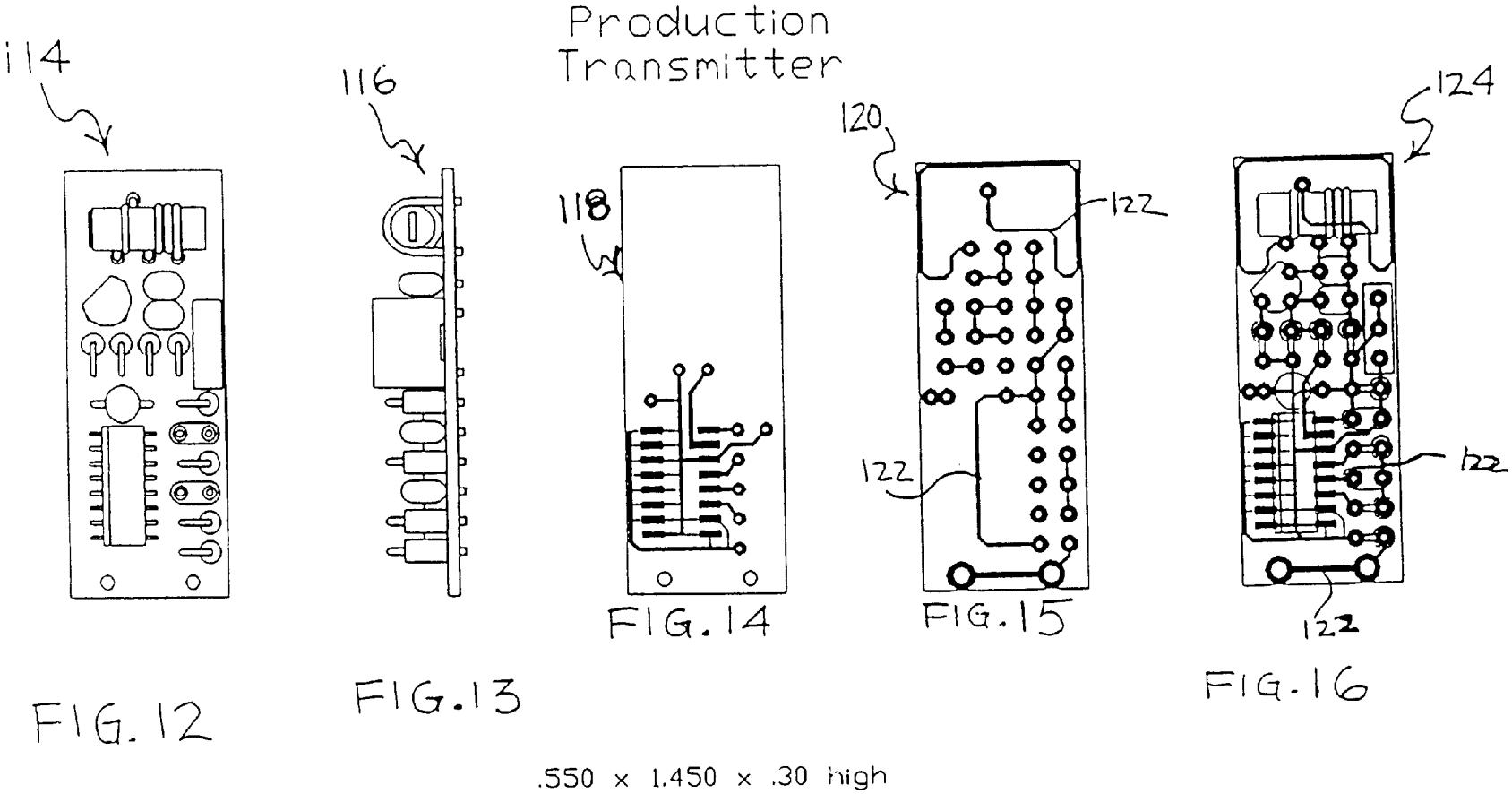

FIG. 12 shows a top view of a board design for a production transmitter.

FIG. 13 shows a side view of the production transmitter board.

FIG. 14 illustrates details the component side of the bare production transmitter board.

FIG. 15 provides a detailed view of the circuit side of the bare production design transmitter board.

FIG. 16 is a composite view of the production transmitter board.

Figure 17:
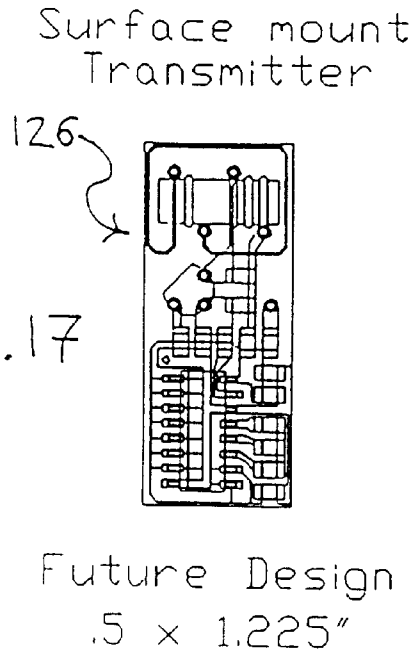

FIG. 17 is a top view of the surface mount transmitter board embodiment.

Figure 18:
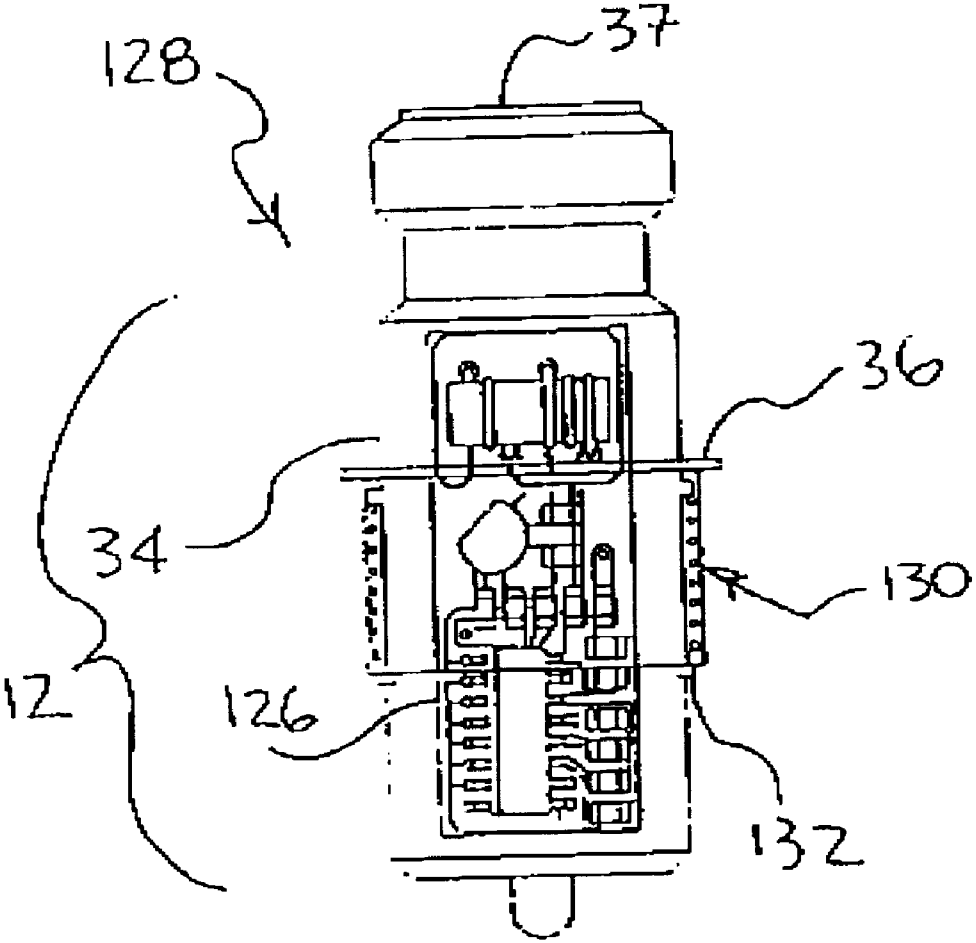

FIG. 18 is a detailed plan view of the surface mount remote emitter assembly.

Figure 19:
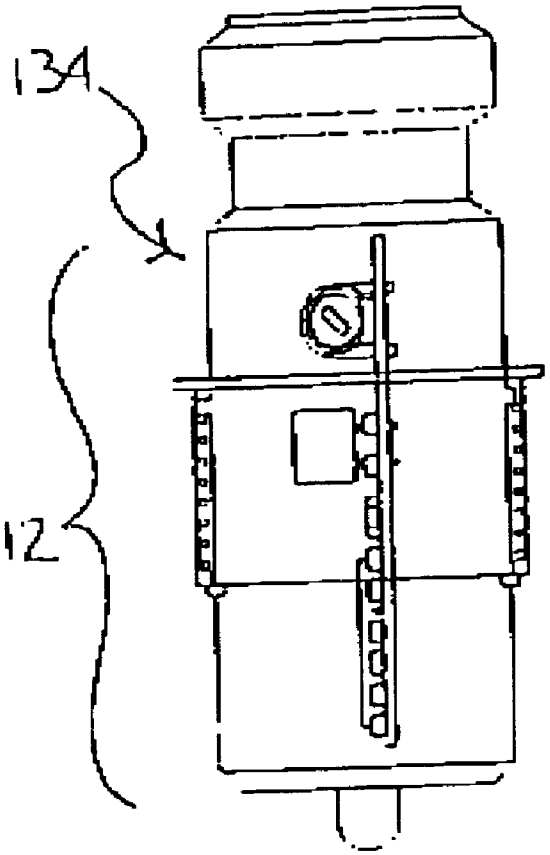

FIG. 19 is a detailed side view of the surface mount remote emitter assembly.

Figure 20:
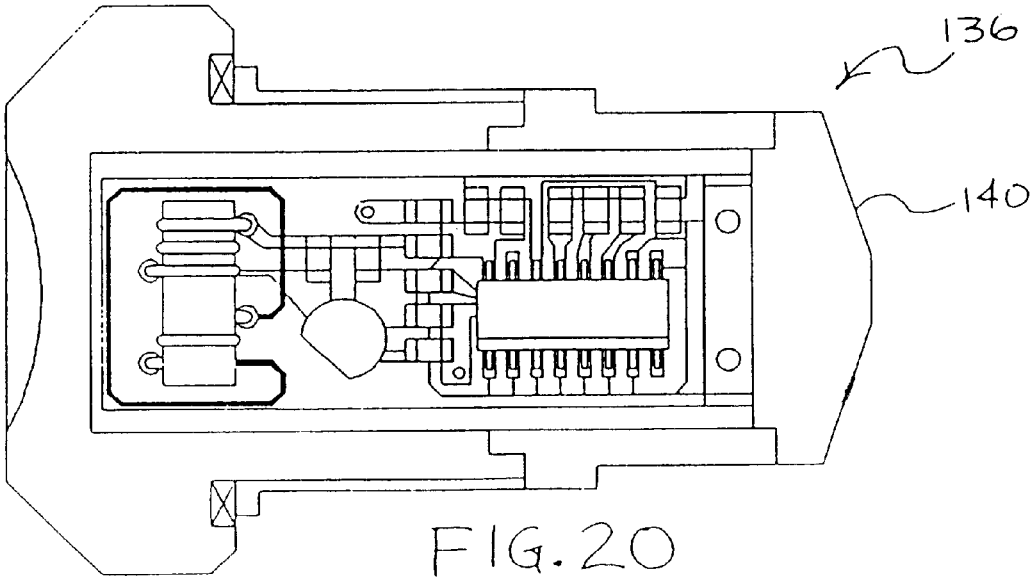

FIG. 20 provides a plan view of an alternate transmitter embodiment.

Figure 21:
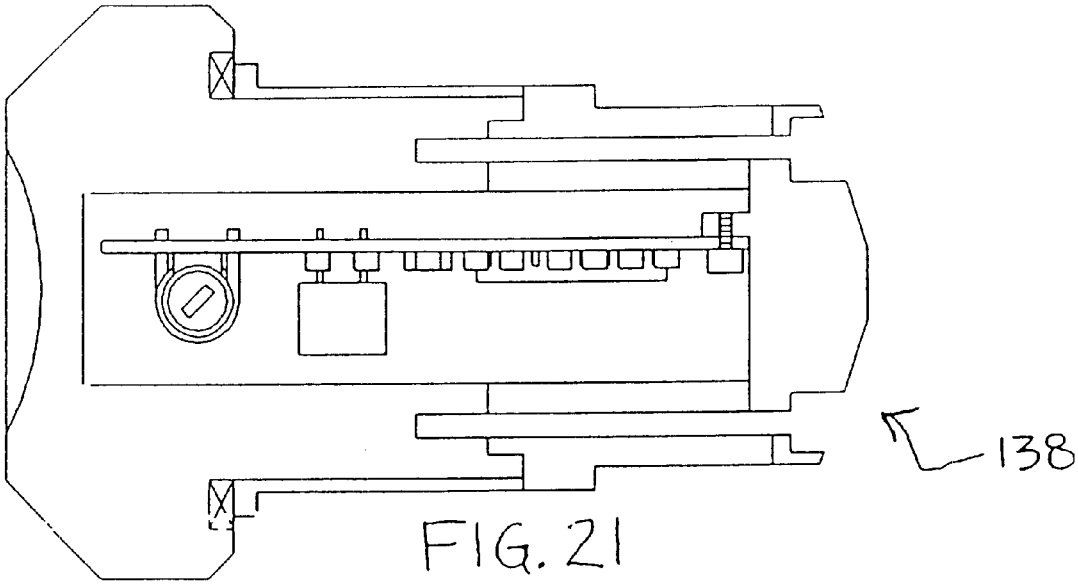

FIG. 21 is a side view of the alternate transmitter embodiment.

Figure 22:
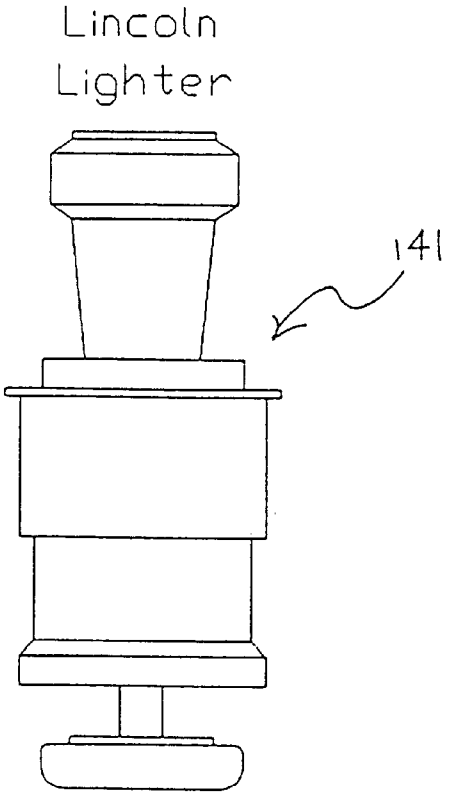

FIG. 22 shows the remote emitter designed to fit in the cigarette lighter receptacle of a Lincoln™ automobile.

Figure 23:
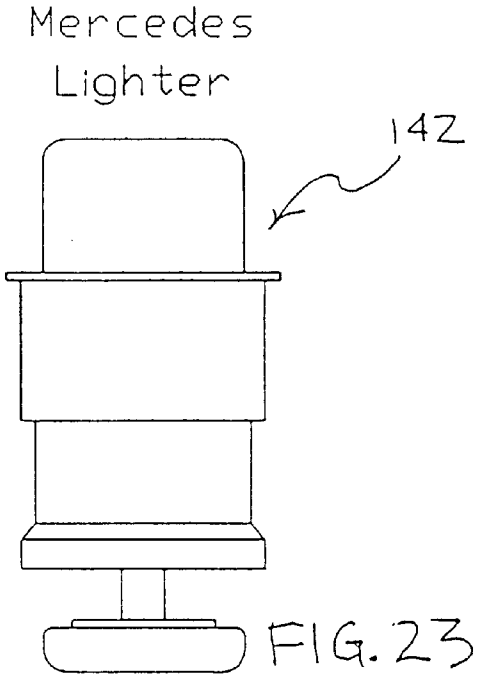

FIG. 23 shows the remote emitter designed to be used in the cigarette lighter receptacle of a Mercedes Benz™.

Figure 24:
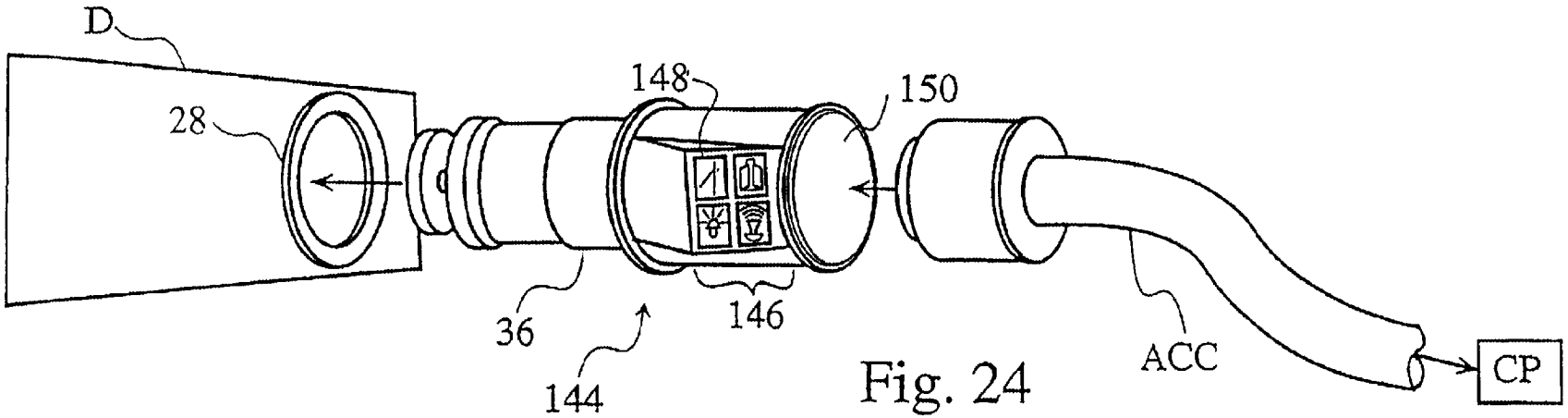

FIG. 24 is an expanded view of an alternate embodiment of an extended remote emitter.

Figure 25:
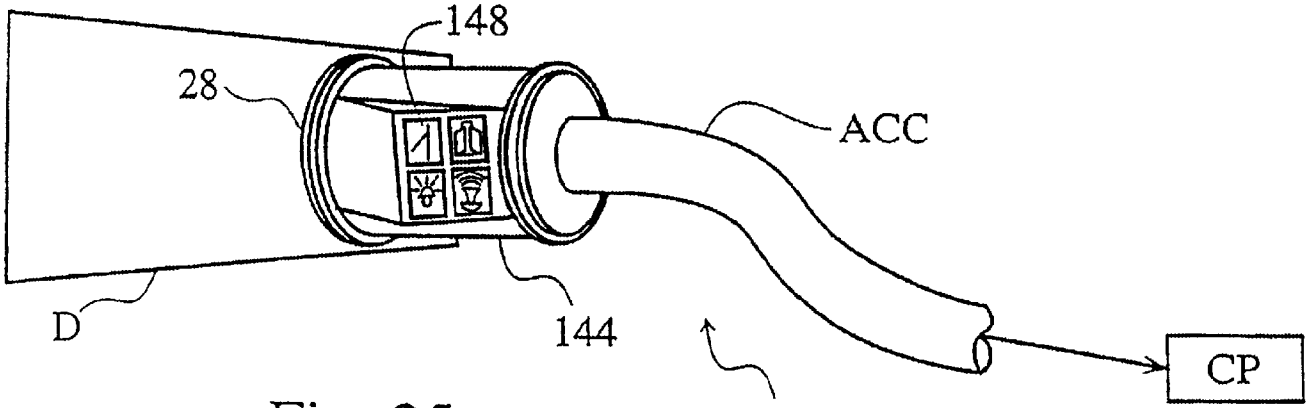

FIG. 25 shows an installed view of the extended remote emitter.

FIG. 26 reveals a block diagram of another alternate embodiment of the present invention, the Miniature Transceiver Control System.

FIG. 27 is a perspective illustration of the remote transceiver, as it would be installed in the console of a vehicle.

FIG. 28 is a block diagram of the power circuitry for the remote transceiver.

DETAILED DESCRIPTION OF PREFERRED & ALTERNATIVE EMBODIMENTS

System Overview

Figure 1:
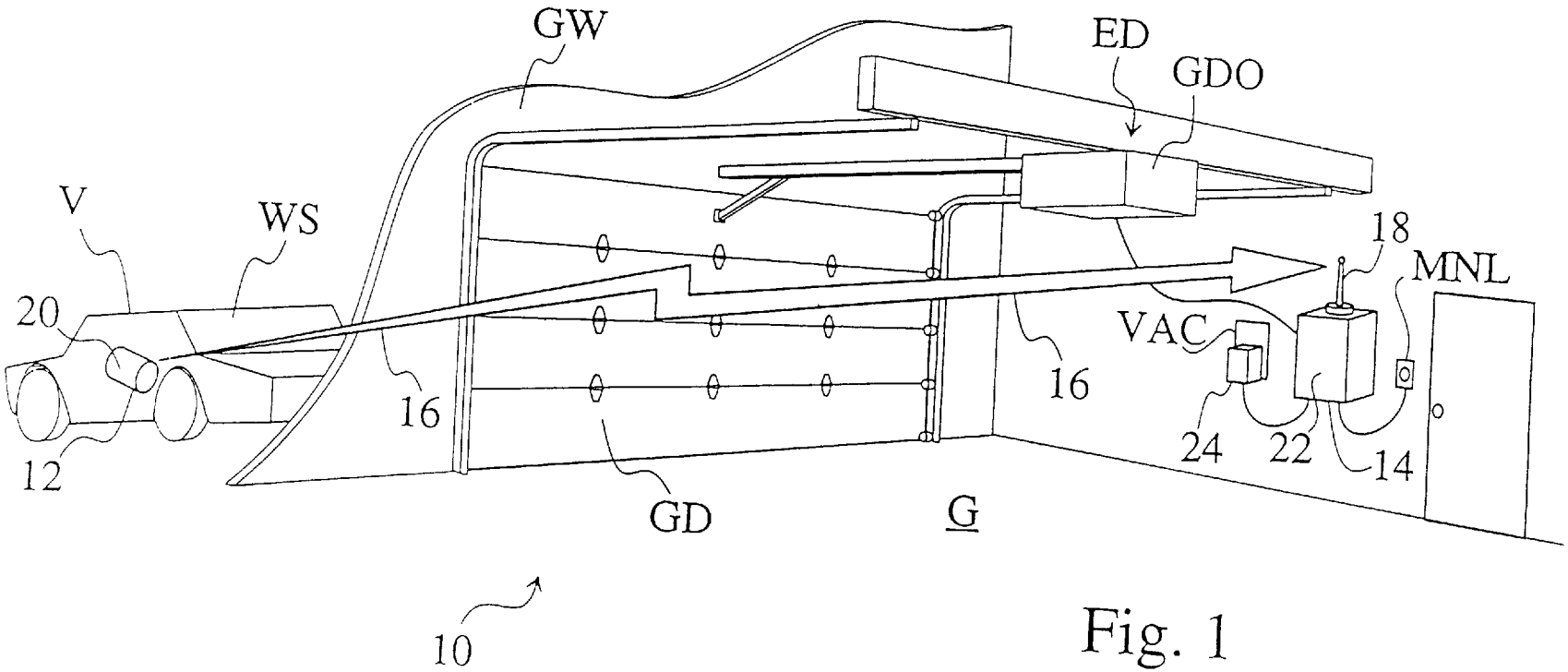
FIG. 1 is an illustration of the Miniature Remote Control System, using a cutaway view of a garage area of a building. This illustration shows how the present invention would be used to provide remote operation of a standard garage door opener mechanism.

FIG. 1 is an illustration of the Miniature Remote Control System 10, which shows a cutaway view of a garage area G. The Miniature Remote Control System 10 provides a miniature, radio frequency remote emitter 12 that is designed be installed within a vehicle V. The remote emitter 12 is used to operate an external device ED, such as a garage door opener GDO, that is connected to a remote receiver 14. When activated, the remote emitter 12 transmits a 380 MHz coded serial pulse train 16. At this frequency, the coded serial pulse train 16 can easily penetrate obstructions located between the remote emitter 12 and the remote receiver 14, such as the vehicle V, the vehicle windshield W, the garage wall GW, and the garage door GD. In the claims, the term "carrier signal" encompasses any coded serial pulse trains 16 described in the specification.

The remote emitter 12 is able to transmit the serial pulse train 16 to the remote receiver 14 from a distance up to 200 feet away. When in range, the remote receiver 14 senses the incoming serial pulse train 16 through the receiver antenna 18. The remote receiver 14 processes the coded signal pulse train 16, and extracts the serial transmitter code 20. The transmitter code 20 is then compared to the preset receiver code 22. If the transmitter code 20 and the receiver code 22 are identical, the remote receiver 14 provides the logic necessary to provide power to operate an external device ED, such as the garage door opener GDO.

The remote receiver 14 is powered by a 16 volt direct current power converter 24 which is attached to an existing alternating current power source (VAC). In this embodiment, the garage door opener GDO can also be activated by overriding the remote receiver 14 by using a manual button MNL.

Figure 2:
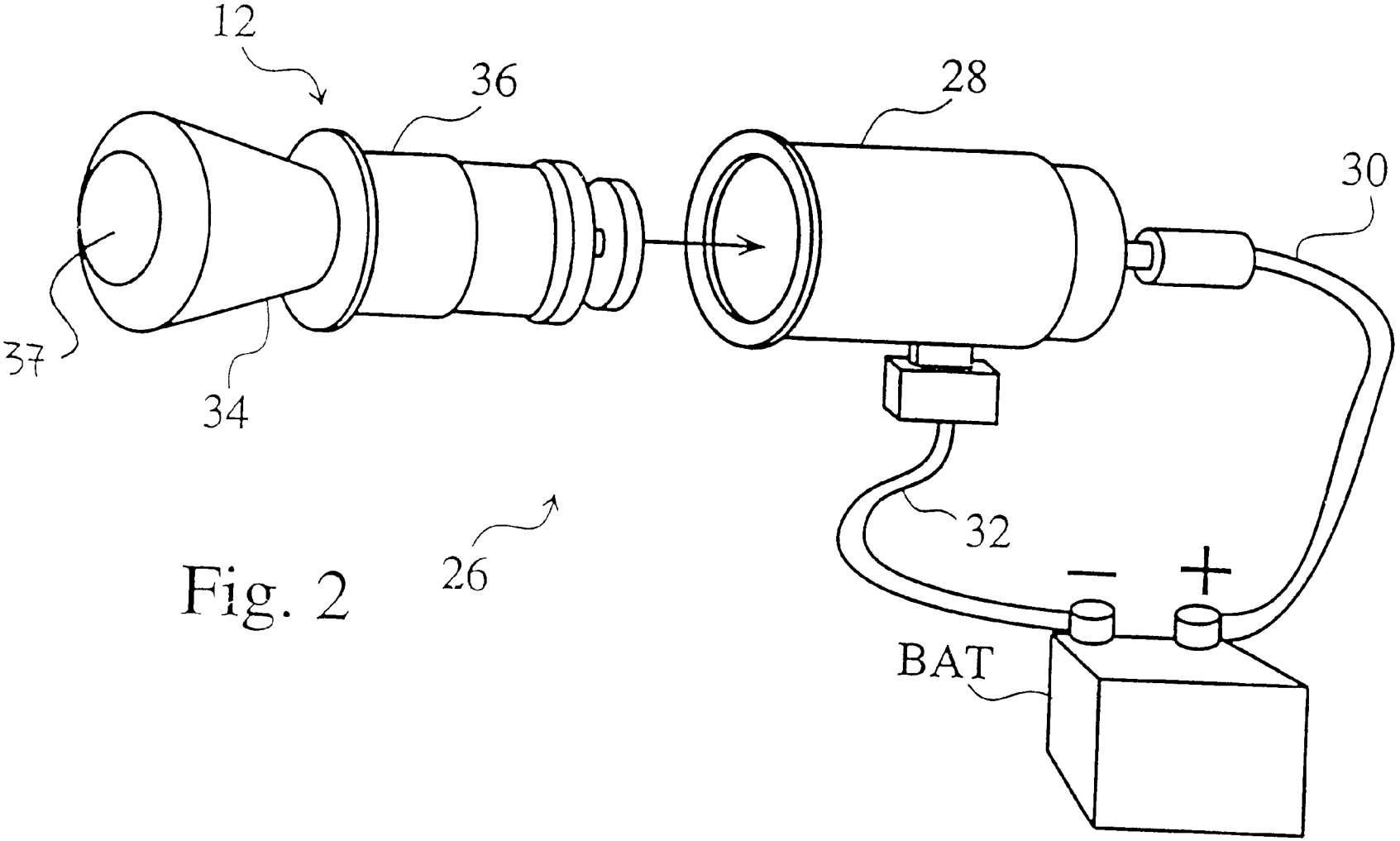
FIG. 2 is a perspective assembly view of the remote emitter and a matching lighter receptacle into which the remote emitter would be installed.

FIG. 2 shows a perspective view 26 of the remote emitter 12 and portrays how the remote emitter 12 would be installed in a cigarette lighter receptacle 28 which is located in a vehicle V. The lighter receptacle 28 is supplied with a direct voltage source BAT from the vehicle V, with a positive polarity connection 30 and a negative polarity connection 32.

The emitter body 34 of the remote emitter 12 is an exterior housing that encloses the internal components of the remote emitter 12. An emitter retainer 36 is used to correctly locate the remote emitter 12 within the lighter receptacle 28. The emitter retainer 36 also acts as an electrical conducting channel between the remote emitter 12 and the negative polarity connection 32. A switch 37 is located on top of the emitter body 34, which is manually activated by the user to power the remote emitter 12 and send a serial coded pulse train 16.

Figure 3:
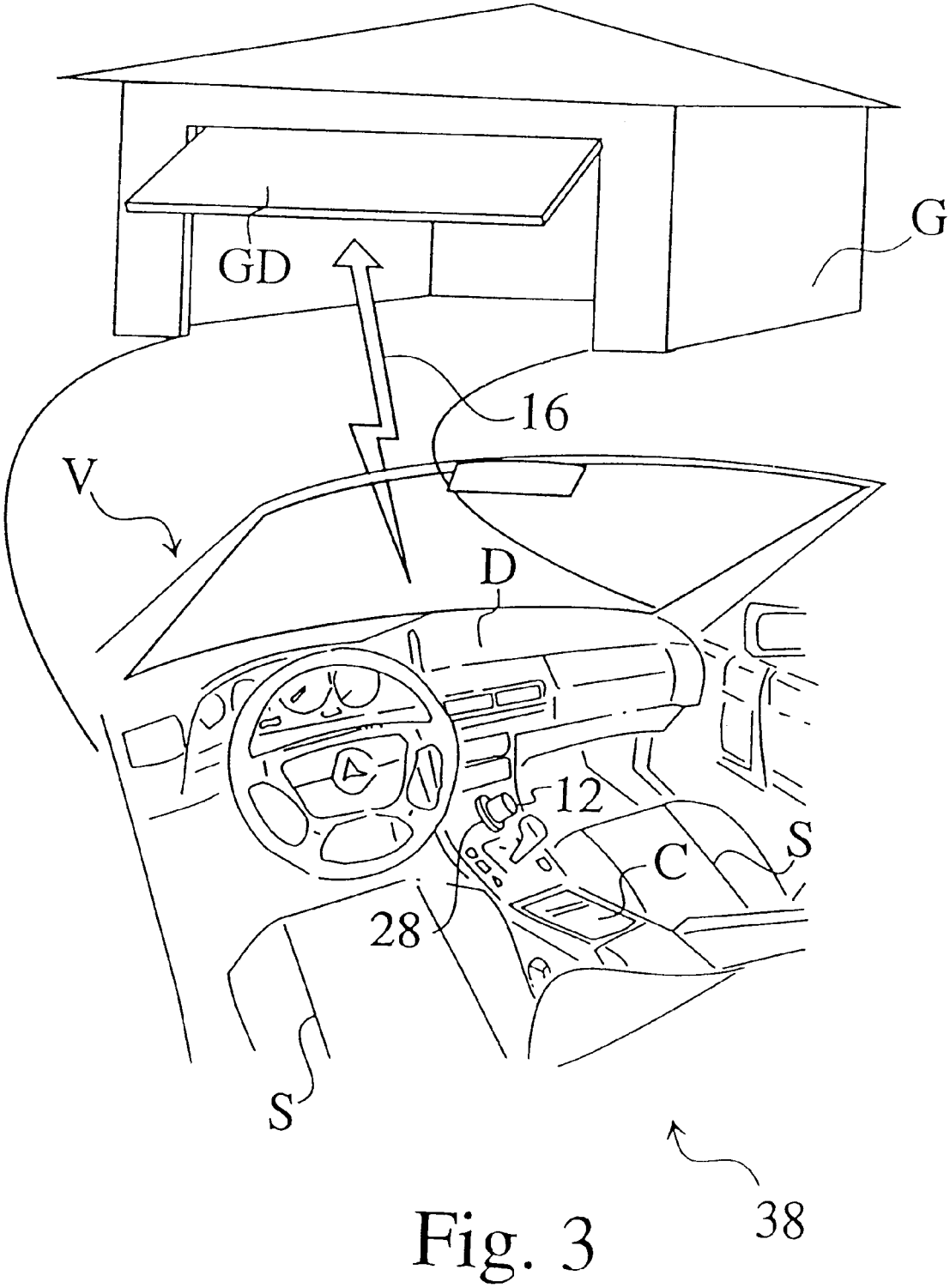
FIG. 3 is an depiction showing the remote emitter installed within the interior of a vehicle. As the vehicle approaches a garage, the remote emitter is activated to send a carrier signal to open a garage door.

A view of the installed controller 38 is shown in FIG. 3. The remote emitter 12 is installed in a lighter receptacle 28 which is located inside a vehicle V. The lighter receptacle 28 is located in different locations within the vehicles V of various manufacturers, but is usually located on the dashboard D or a console C, as indicated by FIG. 3. The location of the lighter receptacle 28 is designed by vehicle manufacturers to be conveniently accessed by the driver or passenger while they are seated in seats S.

FIG. 3 also portrays how the remote emitter 12 would be used to transmit a coded signal pulse train 16 towards a garage G and a garage door GD. As a driver located in vehicle V approaches a garage G, the driver can easily reach and activate the remote emitter 12 by simply pushing down the switch 37 on top of the emitter body 34. Upon activation, the remote emitter 12 emits the coded serial pulse train 16, which includes a unique transmitter code 20 (one of 19,683) on a 380 MHz carrier frequency.

FIG. 4 shows a detailed illustration 40 of an approaching vehicle V as it arrives at a residential building B and a garage G. The coded serial pulse train 16 is transmitted from a remote emitter 12 located in the vehicle V. In this application, the pulse train 16 is used to activate a remote receiver 14 that can provide the logic necessary to open or close a garage door GD.

FIG. 5 is a depiction 42 of an alternative embodiment of the present invention in which the remote receiver 14 is contained within an integrated garage door opener 44.

FIG. 6 is a plan view 46 of some of the many useful applications for which the Miniature Remote Control System 10 may be used. Upon arriving at or departing from a building B, a user in vehicle V can activate the remote emitter 12 to send a coded serial pulse train 16 to a security gate receiver 48 in order to open or close a security gate SG. Exterior lighting EL can be controlled in a similar manner using an exterior light receiver 50. Sprinklers LC can be activated or shut off using a landscape control receiver 52, thus allowing the vehicle passengers to exit the vehicle V without getting wet. The remote emitter 12 may also be used to arm or to disarm a home alarm and security system SA by using a security system receiver 54. Other devices inside the building B may activated, by using a remote emitter 12 to activate an interior lighting receiver 56 to turn lights IL off or on around the house B, or by activating a climate control receiver 58 to operate heating and air conditioning systems AC.

A schematic diagram of the transmitter circuitry 60 within the remote emitter 12 is revealed in FIG. 7. To activate the remote emitter 12, the user simply pushes down the switch 37 on the emitter body 34, which allows the transmitter circuitry 60 to be energized with the 13.7 volt DC power supplied by the positive polarity connection 30 and the negative polarity connection 32 in the vehicle V.

The transmitter circuitry 60 incorporates three primary systems, including the emitter power supply 62, the emitter encoder 64, and the emitter oscillator 66. The emitter power supply 62 provides filtered direct voltage power to the emitter encoder 64 and the emitter oscillator 66. The emitter encoder 64 uses an encoding chip 68, which in this embodiment is an MC 145026, manufactured by Motorola. Nine trinary code input traces 70 are supplied into the encoding chip 68. When the transmitter circuitry 60 is manufactured, the input traces 70 are selectively cut to produce high, low, or open states. In this manner, each remote emitter 12 produced can have one of 19,683 unique transmitter codes 20, derived from $3^9$ possible configurations.

A timing network 72 is also provided within the emitter encoder 64. The timing network 72 consists of an RTC timing resistor 74, a CTC timing capacitor 76, and a source resistor 78. The source resistor 78 is used as a buffer for the timing network 72. The clock frequency of the encoder 64 is determined by the selection of values for the RTC timing resistor 74 and the CTC timing capacitor 76. This frequency is determined by the following relationship:

$$\text{Clock Frequency (cycles/sec)} = 1/(2.3 * CTC * RTC).$$

To obtain more unique transmitter codes 20 for the remote emitter 12 than the 19,683 possible combinations offered by the encoding chip 68 alone, values of the RTC timing resistor 74 and the CTC timing capacitor 76 can be changed.

When activated, the emitter oscillator 66 produces the encoded serial pulse train 16. A 1.0 uH 5% emitter inductor 80 acts as a filter in the transmitter circuitry 60 to isolate the 380 MHz signal produced by the emitter oscillator 66 from the clean voltage necessary for operation of the encoding chip 68. A signal resistor 82 is located between the emitter encoder 64 and the emitter oscillator 66. The value chosen for the signal resistor 82 determines the transmission power of the remote emitter 12. In the preferred embodiment, a 33K signal resistor 82 is used to provide interference free operation between the remote emitter 12 and a remote receiver 14 up to 200 feet away. Appropriate values for the signal resistor 82 are also limited by the maximum allowable transmission power dictated by the Federal Communications Commission (FCC).

A coupling transformer 81 is used to isolate the transmitter circuitry 60 from the emitter antenna 83. This creates a better impedance match between the transmitter circuitry 60 and the emitter antenna 83. In one embodiment of the invention, a circuit trace 122 on the bare production transmitter board 118 may be employed as an antenna for the remote emitter 12. In another embodiment of the present invention, the emitter switch 37 is linked to the emitter oscillator 66. When the switch 37 is depressed by the user, the user becomes the emitter's antenna, and provides an unobstructed line of sight for the coded serial pulse train 16 through the vehicle windshield WS.

FIG. 8 is a schematic diagram of the receiver circuitry 84 used with the remote receiver 14. The incoming 380 MHz serial pulse train signal 16 arrives at the receiver antenna 18, and is then processed by an rf super-regenerative receiver 86. The super-regenerative receiver 86 operates with an extremely wide bandwidth, which allows the Miniature Remote Control System 10 to operate over a very large temperature range. Since the ambient temperature of the remote emitter 12 in a vehicle V or the remote receiver 14 in a building B can commonly be anywhere from 15 degrees F to 130 degrees F, the 380 MHz coded serial pulse train 16 can have a tolerance of as much as +/−5 MHz.

A high frequency filtering circuit 88 is coupled to the super-regenerative receiver 86. Two 0.001F high frequency filter capacitors 90 are coupled to a filter transistor 92. The high frequency filter capacitors 90 act as a buffer between the super-regenerative receiver 86 and the receiver amplifier 94 and data separator 98 circuits.

A data amplifier 94 is then used to begin to amplify the encoded serial pulse train 16. An operational amplifier 96 is used to amplify the 10 KHz serial pulse train 16 by a factor of 10. The operational amplifier 96 has a low frequency bandwidth of only 1–4 MHz, and acts to further filter any residual high frequency components.

A data separator 98 is coupled to the receiver amplifier 94. The data separator 98 adjusts itself to the output signal of the first operational amplifier 96, to allow for signal shift due to temperature variations in the remote emitter 12. The data separator 98 uses a second operational amplifier 100 to compare the actual serial pulse train 16 to the averaged dc level of the serial pulse train 16. A slight amount of hysteresis is added through a 1.5 Meg-ohm resistor 101. This provides clean switching and enhanced noise rejection. The output of the data separator 98 is a faithful reproduction of the serial pulse train 16 output from the emitter encoder 64.

The remaining serial pulse train 16 is output from the data separator 98 to a receiver decoder 102, which in this embodiment is an MC 145028, manufactured by Motorola. The receiver decoder 102 is preset when manufactured with a trinary receiver code 22 to match the transmitter code 20 from the encoding chip 68 in the remote emitter 12. The receiver decoder 102 compares the transmitter code 20 to the receiver code 22. If the two codes 20 & 22 are identical for two sequential serial pulse trains 16 received from the remote emitter 12, the receiver decoder 102 supplies the necessary logic to trigger a relay 104 that will activate the 16 volt DC signal 106 necessary to implement the exterior device ED, such as a garage door opener GDO.

FIG. 9 is a schematic of the receiver power supply 108 which is used to supply the regulated 12 volt DC power necessary for proper function of the receiver circuitry 84 as well as the 16 volt DC power 106 necessary to power the relay 104.

FIG. 10 shows the first receiver circuit board 110 used in the 380 MHz remote receiver circuitry 84, which includes the super-regenerative receiver 86, the receiver amplifier 94, and the data separator 98. FIG. 11 reveals a second receiver circuit board 112 that is used in conjunction with the first receiver circuit board 110 to complete the receiver circuitry 84 within the remote receiver 14. The second receiver circuit board 112 includes the receiver decoder 102 and the receiver power supply 108.

For the remote emitter 12 to fit within in a small area such as a lighter receptacle 28 within a vehicle V, the transmitter circuitry 60 must be able to be packaged within an extremely small volume. FIGS. 12 through 16 illustrate different views of the components that make up the transmitter circuitry 60 within the remote emitter 12. FIG. 12 shows a top view the stacked production transmitter board 114 that achieves all the functionality required of the transmitter circuitry 60 in a micro-miniature design that can fit within the emitter body 34 of the remote emitter 12. FIG. 13 reveals a side view 116 of the production transmitter board 114, whose components and layout have been advantageously chosen to minimize the exterior dimensions of the transmitter circuit board 114.

FIG. 14 illustrates details the component side of the bare production transmitter board 118, from which components are assembled to make up the completed production transmitter board 114. The bare transmitter board 118 is designed to preserve the compact nature of the completed transmitter board 114, while minimizing trace path lengths, and providing adequate room for assembly, quality control, and heat rejection.

FIG. 15 provides a detailed view 120 of the circuit side of the bare transmitter board 118. All board traces 122 on the bare transmitter board 118 are designed to be as short as possible to minimize circuit response time and heat loss, while still providing adequate distance between traces 122 to avoid malfunctions.

FIG. 16 provides a composite view 124 of the production transmitter board 114. This view exemplifies how the components that make up the board 114 have been arranged to advantageously provide an extremely small volume while still allowing adequate room for manufacture, heat rejection, and testing.

FIG. 17 is a top view of a preferred surface-mounted transmitter embodiment 126. The surface-mount transmitter 126 provides all the functionality required for the remote emitter 12, while advantageously employing surface-mounted component assembly design. As the remote emitter 12 can be used for numerous applications, the cost to manufacture the components must be considered to provide as large an installed customer base as possible. Modern automated manufacturing methods and the availability of high quality "surface-mount" electronic components at a reasonable cost has made the surface-mount transmitter 126 desirable to achieve the lowest possible cost of the present invention for the user.

FIG. 18 reveals a detailed plan view 128 of the remote emitter 12. The surface-mount transmitter board 126 is installed inside the emitter body 34. To provide the mechanical connection to locate the remote emitter 12 within the lighter receptacle 28, and to provide the proper electrical pathway between the remote emitter 12 and the negative polarity connection 32, an emitter retainer 36 is provided. The emitter retainer 36 is attached to the emitter body 34 with a spring 130 and a snap ring 132. The spring 130 and snap ring 132 act to provide the user of the remote emitter 12 with a tactile feel when the button 37 is pushed, similar to the spring loaded "snap" of a calculator keypad button that provides a user with a tactile response.

FIG. 19 provides a detailed side view 134 of the embodiment of the remote emitter 12 shown in FIG. 18. This view illustrates how the necessary electronic components that make up the surface mount transmitter 126 are placed to fit within the confines of the emitter body 34 with generous tolerances, allowing the use of multiple parts sourcing for non-interrupted, large-volume manufacture of the remote emitter 12.

FIG. 20 provides an enlarged cut-away plan view of an alternate transmitter embodiment 136 of the remote emitter 12. From this view it can be seen how the surface-mount transmitter circuit board 126 that provides all the required functionality of the remote emitter 12 can be conveniently packaged within the exterior body 34 that can be installed in a common lighter receptacle 28.

FIG. 21 is an enlarged sectional side view 138 of the alternate transmitter embodiment 136 shown in FIG. 20. In this view the transmitter conductive pathway 140 is shown. The conductive pathway 140 makes contact with the positive polarity connection 30 in the vehicle V when the user pushes the button 37 to activate the remote emitter 12. This powers the remote emitter 12 to send a coded serial pulse train 16 to the remote receiver 14 for remote control of an external device ED, such as a garage door opener GDO.

The lighter receptacles 28 and the interior design requirements of vehicles V produced by various manufacturers require that the remote emitter 12 be packaged with slightly different geometries and styling. The production transmitter board 114 is designed to be located within all appropriate emitter bodies 34 which are designed to fit within the standard lighter receptacles 28 of vehicles V produced by substantially all manufacturers. FIG. 22 shows a side view of a remote emitter 141 designed to fit in a Lincoln™ automobile. FIG. 23 reveals a side view of a remote emitter 142 designed to be used in a Mercedes Benz™.

FIGS. 24 and 25 are detailed expanded and installed assembly views of an alternate embodiment of the extended remote emitter 144. This configuration allows expanded functionality and versatility that is advantageous for many users. The extended remote emitter 144 allows the user to control multiple devices ED remotely from a vehicle V, by providing the circuitry and controls to send a number of unique coded serial pulse trains 16 to different external devices ED, such as a garage door opener GDO, a security system receiver 54, a lighting control receiver 56, and a security gate receiver 48. The multiple button keypad 146 shown in FIG. 24 has single buttons 148 devoted to single transmitting functions. Other embodiments that require increased security or the use of a small number of buttons 148 to control a large number of external devices ED may use a keyed combination of required button strokes to provide the correct coded serial pulse train 16 to operate external devices ED.

The location of the multiple button keypad 146 for this embodiment is placed to be easily seen and operated by the user within the vehicle V. To enhance the ease with which the extended remote emitter 144 is used, the single buttons 148 can be color keyed, illuminated, or supplied with names or icons to identify the functions for which they are to be used.

Another feature of the extended remote emitter 144 is the extension receptacle 150 that is shown in FIG. 24. Many modern vehicles V are equipped with optional accessories ACC such as portable cellular phones CP, which often use the lighter receptacle 28 within a vehicle V to supply DC power. The extension receptacle 150 provided by the extended remote emitter 144 allows the attachment of additional accessories ACC, such as cellular phones CP. As the extended remote emitter 144 is designed to draw a very small amount of power from the vehicle DC power source BAT, the use of both the extended emitter 144 and a cellular phone CP within the lighter receptacle 28 is within the amperage limits of vehicle electrical circuit BAT, which is designed to power a cigarette lighter CL.

FIG. 26 reveals a block diagram of another alternate embodiment of the present invention, the Miniature Transceiver Control System 152, which comprises a remote transceiver 154 in a vehicle V, and a secondary transceiver 156 attached to external devices ED. The Miniature Transceiver Control System 152 provides both remote control of external devices ED from a vehicle V, and communication back to the remote transceiver 154 from the secondary transceiver 156.

The Miniature Remote Transceiver System 152 is able to transmit and receive information on a carrier frequency of 902 to 928 MHz. The Federal Communications Communication (FCC) allows a high maximum transmission power for systems operating in the 900 MHz bandwidth. Operation of the Miniature Transceiver Control System 152 in this 900 MHz frequency band allows the system to operate with a range exceeding two miles, while advantageously providing interference free operation from obstacles, such as the vehicle body VB, buildings B, and garage walls GW.

A user in a vehicle V can activate the remote transceiver 154 to send a coded serial pulse train 16 by simply pressing down on buttons 148 located on the transceiver keypad 160. Activation of a desired coded serial pulse train 16 may be accomplished with a stroke of an individual button 148, or may be accomplished with a more elaborate predetermined combination of multiple buttons 148. The transceiver keypad 160 is coupled in series to a transceiver microprocessor 162, a transceiver transmitter 164, and a transceiver antenna 166. When the user supplies the correct transmitter code 20 to the transceiver microprocessor 162, the transceiver microprocessor 162 activates the transceiver transmitter 164 to send the appropriate coded serial pulse train 16 containing the transmitter code 20. The coded serial pulse train 16 provided by the transceiver transmitter 164 is broadcast from the vehicle V, through the transceiver antenna 166, toward the secondary transceiver 156.

The secondary transceiver 156 is typically located in a building B, and is powered by a standard 120 volt alternating current source VAC. The secondary transceiver 156 has inputs for connection to external devices ED, such as security and alarm systems SA, fire detectors FD, garage door openers GDO, and heating and air conditioning systems AC.

The secondary transceiver 156 is able to receive, amplify, and decode the coded serial pulse train 16 sent by the remote transceiver 154, and is able to activate external devices ED, such as security and alarm systems SA and garage door openers GDO. The secondary transceiver 156 is also able to transmit an information pulse train 158 back to the remote transceiver 154.

The remote transceiver 154 is able to receive the information pulse train 158 from the secondary transceiver 156. The information pulse train 158 may contain information for use by the transceiver microprocessor 162, such as new transmitter codes 20 required to provide remote control for external devices ED. The information pulse train 158 may also contain information to be communicated to the user, such as the status of external devices ED, or confirmation of commands sent to the secondary transceiver 156 by the remote transceiver 154. Information regarding the status of external devices ED that can be transmitted to the user may be of great value to the user in a vehicle V. Criminal activity that activates a security and alarm system SA which is connected to a secondary transceiver 156 in a building B can be communicated to a user in a vehicle V. A fire within a building B that activates a fire detector FD which is connected to a secondary transceiver 156 can be communicated to a user.

The information pulse train 158 sent by the secondary transceiver 156 enters the remote transceiver 154 through the transceiver antenna 166. The transceiver antenna 166 is coupled in series to the transceiver receiver 168, the transceiver microprocessor 162, and a backlit liquid crystal display 170. The transceiver microprocessor 162 is also coupled to function LEDs 172. When an information pulse train 158 arrives at the transceiver antenna 166, it is processed by the transceiver receiver 168 and sent to the transceiver microprocessor 162. If the information pulse train 158 contains information for use only by the transceiver microprocessor 162, such as a new transmission code 20, the transceiver microprocessor 162 stores the new transmission code 20 in its memory. If the information pulse train 158 contains information to be communicated with the user in the vehicle V, the transceiver microprocessor 162 sends the information to the liquid crystal display 170 or to the function LEDs 172, where the information is provided to the user.

FIG. 27 is a perspective illustration 174 of the remote transceiver 154, as it would be installed in the console C of a vehicle V. In this embodiment, the remote transceiver 154 is designed to fit within a standard ash tray AT in a vehicle V. A power pickup 176 is provided on the remote transceiver 154 to supply power to the remote transceiver 154 from the vehicle DC power source BAT. The power pickup 176 is designed to fit within a standard cigarette lighter receptacle 28. The transceiver keypad 160 is conveniently located on the upper surface of the remote transceiver 154. A backlit liquid crystal display 170 and a function LED 172 are also provided on the upper surface of the remote transceiver 154, to provide communication to the user from the secondary transceiver 156 in the house B. An extension receptacle 150 is also provided on the remote transceiver 154 to provide a means for attachment of additional accessories ACC, such as cellular phones CP. To install the remote transceiver 154, the cigarette lighter CL and ash tray AT can simply be removed and replaced with the remote transceiver 154.

FIG. 28 is a block diagram of the power circuitry 178 for the remote transceiver 154. Power is supplied to the remote transceiver 154 from the vehicle DC power source BAT through the power pickup 176. A transceiver power supply 180 is located within the remote transceiver 154, and is coupled to the power pickup 176. The transceiver power supply 180 conditions the DC power source BAT to provide appropriate power outputs 182 for components in the remote transceiver 156 and for secondary accessories ACC that are coupled to the extension receptacle 150.

Alternate Antenna Configurations

The operating frequency and radiated power of the present invention is regulated by the FCC. This device must operate within the constraints of those regulations. Under Section 15.231, periodic operation in the band 40.66–40.70 MHz and above 70 MHz of remote control devices such as garage door openers are allowed. Since the allowable radiated field strength is low (<12,500 $\mu$V/meter average value measured at 3 meters for frequencies above 470 MHz), the method of coupling the RF energy into the antenna can be primarily driven by economics as opposed to power efficiency. Most importantly, the RF energy must exit the car, usually through a multipath composing of several reflections, and enter the house or a garage where a receiver intercepts the signal and operates the garage door or other device.

Modulation & Message Coding

The basic system operates at 900 MHz when the operator presses the button labeled "Close Switch." At the time of switch closure, the transmitter begins sending a coded message to the receiver. Once activated by the switch, the transmitter automatically ceases transmission within five seconds after the switch is released. There are two key features of the coded message. First, a unique code is repeatedly transmitted. The receiver is designed to look for codes that have been identified as valid for executing the desired remote function such as opening the garage door. The receiver must receive the same correct code three times before it allows the remote operation. The fact that three correct codes must be received is based upon current technology. The intent is to avoid susceptibility to random noise. In fact, more than three makes for a more robust system. The only problem with increased required occurrences is the length of time the operator must wait before the remote device begins to respond. The present invention is designed to make the reaction appear to be instantaneous from a user's point of view. To take advantage of power averaging, the code will be repeated at a rate of twenty times per second on average. Secondly, the transmitter uses an "ALOHA" messaging scheme. ALOHA is a messaging technique that allows multiple users to operate simultaneously on the same frequency.

When dealing with shared channels (a channel being an assigned frequency band), one must be prepared to resolve conflicts that arise when more than one demand is placed on the channel. For example, in the case of multiple garage door devices within close proximity, whenever a portion of the transmission of one user overlaps with the transmission of another user, then the two collide and "destroy" each other, unless a random access technique such as ALOHA is utilized.

Pure ALOHA permits a user to transmit any time it desires. If a user transmits a code word, and within some appropriate time-out period following its transmission it receives an acknowledgment from the destination, then it knows that no conflict occurred. Otherwise, it assumes that a collision occurred and it must retransmit. To avoid continuously repeated conflicts, The retransmission delay is randomized across the transmitting devices, thus spreading the retry packets over time. This approach works most effectively with a transceiver on both ends. However, that basic ALOHA approach still works using the operator as the feedback for acknowledging the garage door has opened or closed. A basic system using ALOHA, the transmitter sends a coded message upon switch closure and then waits a period of time before retransmitting the message. This process is repeated until the operator releases the switch. The delay between messages is a random period of time. The time between messages is long with respect to the time it takes to transmit a message. The transmitter codes the RF using pulse modulation. Therefore, the transmitter does not emit RF energy while waiting to send the message.

Basic Receiver

The receiver is operational at all times waiting for the correct message to be decoded by the RF receiver. After the receiver get three valid messages, the remote operation is performed such as opening a garage door. This is one of three basic modes of operation. The second mode of operation is the entry of new valid codes. This is achieved by holding down the programming button "switch" and operating the new transmitter. The receiver reads in the coded message and saves the code word in the non volatile random access memory NOVRAM. The new transmitter is now capable of operating the remote system. The third mode of operation is clearing or resetting of all stored codes in the NOVRAM of the receiver. This is done by turning power on while the programming button is pressed. Upon boot-up the microcontroller recognizes the depressed programming button and then erases the contents of the NOVRAM.

Manufacturing

For low cost manufacturing purposes, all receivers are initially configured during the manufacturing process with the same code. This is accomplished within the software design. This allows for simple testing of the receiver as it is being built.

The transmitter randomly selects a code word on initial power up. This gives the transmitter a unique code word that is stored in NOVRAM. The random selection of the code word is done partly with the hardware timer that is built into the microcontroller and through a software timer. Upon the initial power-on and boot-up process the microcontroller checks to verify that a valid code word has been stored in the NOVRAM. If there is no code word the microcontroller starts the hardware and software timers. The operator, some random time later, will push the button marked "Close the switch." This stops the counters and the microcontroller loads the contents of the counters into the NOVRAM as the valid code word. The operator is most likely to be a technician during the testing phase of the manufacturing process. The microcontroller is capable of counting very fast. The hardware and software counters count from zero to maximum count more than twenty times a second. After maximum count the counters automatically start over at zero. The operator pressing the button randomizes the process. This random number algorithm can produce over a billion unique code words.

This method allows the transmitters and receivers to be built and tested independently. Transmitters and receivers are not matched pairs, nor do they require the setting of DIP (dual in-line package) switches. Replacement transmitters can be purchased and programmed into the receiver.

The invention also provides several alternative methods of programming the transmitter with unique codes. An additional connector could be used to down load information. However, this concept is inferior due to the cost and physical location constraints of the application. Instead, a technique has been developed that allows the information to be encoded on the power supply leads. Therefore, the unique codes can be downloaded without adding additional cost or complexity to the transmitter circuit. This is an important concept for making transmitters compatible with or vendors receivers. Current state of the art devices change codes by selecting settings on a DIP switch, on both the transmitter and receiver. With this embodiment, the user can program the transmitter with a compatible code and then set the dip switches on the receiver to match the transmitter. It is envisioned that a distributor will sell transmitters independent of the receiver for replacement of lost or broken transmitters. The distributor would concurrently provide a service of allowing the user to select a code to be programmed into the transmitter NOVRAM. This is accomplished with a special box that the user can plug the transmitter into and activate the programmer. The process only takes a few seconds and allows the user to either pick a code or allow the box to randomly select a code and then print out the code word so that the dip switches can be properly set on the receiver.

CONCLUSION

Although the present invention has been described in detail with reference to particular preferred and alternative embodiments, persons possessing ordinary skill in the art to which this invention pertains will appreciate that various modifications and enhancements may be made without departing from the spirit and scope of the Claims that follow. The imaging equipment that has been disclosed above is presented to educate the reader about particular embodiments, and is not intended to constrain the limits of the invention or the scope of the Claims. The List of Reference Characters which follows is intended to provide the reader with a convenient means of identifying elements of the invention in the Specification and Drawings. This list is not intended to delineate or narrow the scope of the Claims.

| LIST OF REFERENCE CHARACTERS | |
|---|---|
| 10 | Miniature Remote Control System |
| 12 | Remote emitter |
| 14 | Remote receiver |
| 16 | Coded serial pulse train |
| 18 | Receiver antenna |
| 20 | Transmitter code |
| 22 | Receiver code |
| 24 | Receiver power converter |
| 26 | Perspective view of remote emitter |
| 28 | Cigarette lighter receptacle |
| 30 | Positive polarity connection |
| 32 | Negative polarity connection |
| 34 | Emitter body |
| 36 | Emitter retainer |
| 37 | Switch |
| 38 | Installed Controller |
| 40 | Illustration of approaching vehicle |
| 42 | Depiction of integrated garage door opener |
| 44 | Integrated garage door opener |
| 46 | Plan view of applications |
| 48 | Security gate receiver |
| 50 | Exterior light receiver |
| 52 | Landscape control receiver |
| 54 | Security system receiver |
| 56 | Interior lighting receiver |
| 58 | Climate control receiver |
| 60 | Transmitter circuitry |
| 62 | Emitter power supply |
| 64 | Emitter encoder |
| 66 | Emitter oscillator |
| 68 | Encoding chip |
| 70 | Trinary code input traces |
| 72 | Timing network |
| 74 | RTC timing resistor |
| 76 | CTC timing capacitor |
| 78 | Source resistor |
| 80 | Emitter inductor |
| 81 | Coupling transformer |
| 82 | Signal resistor |
| 83 | Emitter antenna |
| 84 | Remote receiver circuitry |
| 86 | Super-regenerative receiver |
| 88 | High frequency filtering circuit |
| 90 | High frequency filter capacitor |
| 92 | Filter transistor |
| 94 | Data amplifier |
| 96 | First operational amplifier |
| 98 | Data separator |
| 100 | Second operational amplifier |
| 102 | Receiver decoder |
| 104 | Relay |
| 106 | 16 volt DC signal |
| 108 | Receiver power supply |
| 110 | First receiver board |
| 112 | Second receiver board |
| 114 | Production transmitter board |
| 116 | Side view of production transmitter board |
| 118 | Bare transmitter board |
| 120 | Circuit side of bare production board |
| 122 | Board traces |
| 124 | Composite view of production transmitter board |
| 126 | Surface mounted transmitterboard |
| 128 | Plan view of remote emitter |
| 130 | Spring |
| 132 | Snap ring |
| 134 | Detailed side view of remote emitter |
| 136 | Alternate transmitter embodiment |
| 138 | Sectional side view of alternate transmitter embodiment |
| 140 | Conductive pathway |
| 141 | Remote emitter to fit in Lincoln ™ automobile |
| 142 | Remote emitter to fit in Mercedes Benz ™ automobile |
| 144 | Extended remote emitter |
| 146 | Multiple button keypad |

-continued

| LIST OF REFERENCE CHARACTERS | |
|---|---|
| 148 | Single button |
| 150 | Extension receptacle |
| 152 | Miniature Transceiver Control System |
| 154 | Remote transceiver |
| 156 | Secondary transceiver |
| 158 | Information pulse train |
| 160 | Transceiver keypad |
| 162 | Transceiver microprocessor |
| 164 | Transceiver transmitter |
| 166 | Transceiver antenna |
| 168 | Transceiver receiver |
| 170 | Liquid crystal display |
| 172 | Function LEDs |
| 174 | Perspective illustration of remote transceiver |
| 176 | Power pickup |
| 178 | Remote transceiver power circuitry |
| 180 | Transceiver power supply |
| 182 | Power outputs |
| AC | Heating and air conditioning system |
| ACC | Secondary accessories |
| ANT | Antenna |
| AT | Standard ashtray |
| B | Building |
| BAT | Vehicle DC power source |
| BT | Button |
| C | Console |
| CA | Cap |
| CL | Cigarette lighter |
| CP | Cellular phone |
| D | Dashboard |
| ED | External device |
| EL | Exterior lighting |
| FD | Fire detector |
| G | Garage |
| GD | Garage door |
| GDO | Garage door opener |
| G | Garage wall |
| GR | Ground ring |
| IL | Indoor lighting |
| LC | Sprinklers |
| M | Mold |
| MNL | Manual button |
| PCB | Printed circuit board |
| PL | Power lead |
| PP | Pressure plate |
| PR | Power ring |
| S | Passenger seating |
| SA | Security and alarm system |
| SG | Security gate |
| V | Vehicle |
| VAC | Alternating current power source |
| VB | Vehicle body |
| W | Windshield |

What is claimed is:

1. A method comprising the steps of:

activating an emitter (12); said emitter being mounted in a cigarette lighter receptacle (28) mounted in a vehicle (V) having an on-board power source (BAT);

generating a carrier signal (16) when said emitter (12) is activated; said carrier signal having an embedded predetermined transmission code (20); and sensing said carrier signal (16) generated by said emitter (12) using a receiver (14); said receiver (14) being coupled to an external device (ED) which is activated when said carrier signal having an embedded predetermined transmission code is sensed;

said emitter includes a micro-controller, said micro-controller being programmable using input voltage and ALOHA protocol software;

said emitter also having a voice recognition circuit for providing voice recognition operation;

said emitter including a molded housing; said emitter including a switch contact ring which is encapsulated and formed integrally in said molded housing; said emitter further including an antenna; said antenna being energized when said switch contact ring is engaged;

said adapter being capable of coupling a secondary accessory to said emitter.

2. A method as recited in claim 1, in which said receiver is programmed with special visitor codes.

3. A method as claimed in claim 1, in which said emitter is coded using an ALOHA random access technique which allows multiple users to operate simultaneously on the same frequency.

4. A method as recited in claim 1, in which said emitter further includes a programming button, and said emitter is programmed with a new code by simultaneously depressing said programming button and said switch.

5. A method as recited in claim 1, in which said emitter is cleared of programming by turning power on while said programming button is pressed.

6. A method as recited in claim 1, in which said emitter further includes a random code generator is used to select an emitter code.

7. A method as recited in claim 1, in which said emitter code is selected when said emitter is turned on.

8. A method as recited in claim 1, in which said emitter and said receiver are not a matched pair and do not require setting of DIP switches.

9. A method as recited in claim 1, in which said emitter is encoded on emitter power supply leads so unique codes can be downloaded without adding additional cost or complexity to said emitter.

10. A method as recited in claim 1, in which said emitter is encoded using a universal programing box that the user can plug into said emitter.

11. A method as claimed in claim 1, in which said external device is a garage door opener.

12. A method as claimed in claim 1, in which said secondary accessory is a cellular phone.

13. A method as recited in claim 1, in which said receiver is used to control traffic in a gated community.

14. A method as recited in claim 1, in which said receiver is a multi-channel receiver which is programmed with authorization codes of members of said gated community.

* * * * *